US005305369A

United States Patent [19]

Johnson et al.

[11] Patent Number: 5,305,369

[45] Date of Patent: Apr. 19, 1994

[54] BUCKY DRIVE SYSTEM

[75] Inventors: Glenn J. Johnson, Aurora; John Pischl, Glen Ellyn, both of Ill.

[73] Assignee: Material Control, Inc., Crosswell, Mich.

[21] Appl. No.: 29,696

[22] Filed: Mar. 11, 1993

[51] Int. Cl.[5] ..... G21K 1/00

[52] U.S. Cl. ..... 378/155; 378/147; 378/154

[58] Field of Search ..... 378/155, 145, 147, 149, 378/154, 186

[56] References Cited

U.S. PATENT DOCUMENTS

| | | | |
|---|---|---|---|
| 3,660,660 | 5/1972 | Pearson et al. . | |
| 4,063,100 | 12/1977 | Williams . | |
| 4,071,767 | 1/1978 | Pury et al. . | |
| 4,095,110 | 6/1978 | Bunch . | |
| 4,096,391 | 6/1978 | Barnes . | |
| 4,105,920 | 8/1978 | Pury et al. . | |
| 4,380,086 | 4/1983 | Vagi | 378/155 |
| 4,416,020 | 11/1983 | Wagner et al. . | |
| 4,646,340 | 2/1987 | Bauer . | |
| 4,754,471 | 6/1988 | Dieterlen . | |
| 4,760,589 | 7/1988 | Siczek . | |
| 4,829,547 | 5/1989 | Mustain . | |
| 4,845,733 | 7/1989 | Dieterlen et al. . | |
| 4,930,147 | 5/1990 | Dieterlen et al. . | |
| 4,987,581 | 1/1991 | Bernardi | 378/155 |
| 5,008,920 | 4/1991 | Gralak . | |
| 5,062,130 | 10/1991 | Fago . | |
| 5,212,719 | 5/1993 | Virta et al. | 378/155 |

FOREIGN PATENT DOCUMENTS

| | | |
|---|---|---|
| 02400040 | 9/1925 | United Kingdom . |

*Primary Examiner*—David P. Porta
*Attorney, Agent, or Firm*—Dykema Gossett

[57] ABSTRACT

An improved bucky drive utilizes a reversible rotary motor which drives a screw received in a nut fixed to a bucky grid. A integrated control circuit board for the motor insures that the motor is quickly operated. In other features, the motor is a DC motor with a position sensor. A transistor speed control is utilized. The bucky system may be operated in either a semi-automatic or an automatic mode. The speed of the grid may be controlled. Further, other operational parameters of the system may also be controlled.

4 Claims, 1 Drawing Sheet

BUCKY DRIVE SYSTEM

BACKGROUND OF THE INVENTION

This invention relates to improvements in the motor drive for an x-ray bucky system.

In the prior art, a bucky with a moving grid is utilized to prevent exposure of x-ray film to secondary radiations that might otherwise create shadows that could blur or obscure the image to be produced on the x-ray film. The grid is moved during the exposure of the x-ray film to prevent such shadows on the film.

In the prior art, a grid is often driven to reciprocate during the exposure of the x-ray. The drive systems must be controlled in combination with the x-ray system.

It would be desirable to improve the drive systems for such a bucky, including mechanical features of the drive, and the electronic controls for such drives.

SUMMARY OF THE INVENTION

In a preferred embodiment of the present invention a reversible DC motor drives a screw which receives an internally threaded nut. The internally threaded nut is fixed to move with the grid. The screw is rotated in a first direction to move the nut, and hence the grid, in a first linear direction. At the end of a path of travel, the motor and screw is reversed, bringing the nut back linearly to a return position. The screw and nut drive operates more smoothly and quickly than prior art drives. This reciprocation is performed during exposure of the x-ray film.

In further features of the present invention an integrated circuit chip control board is utilized to control the motor. The motor is preferably a DC motor. The use of the IC control allows the grid to be reciprocated more quickly. The position sensor is driven by the motor, through a set of gears, and preferably monitors the position of the motor to provide an indication of the location of the grid.

The control system may be operated automatically such that it is actuated upon actuation of the x-ray system, or alternatively may be semi-automatic in that an operator must actuate the bucky for movement after actuation of the x-ray. In further features, the bucky may be operated at varying speeds, and a transistor speed control may be incorporated into the control system.

These and other features of the present invention can be best understood from the following specification and drawings, of which the following is a brief description.

DETAILED DESCRIPTION OF A PREFERRED EMBODIMENT

Figure 1:
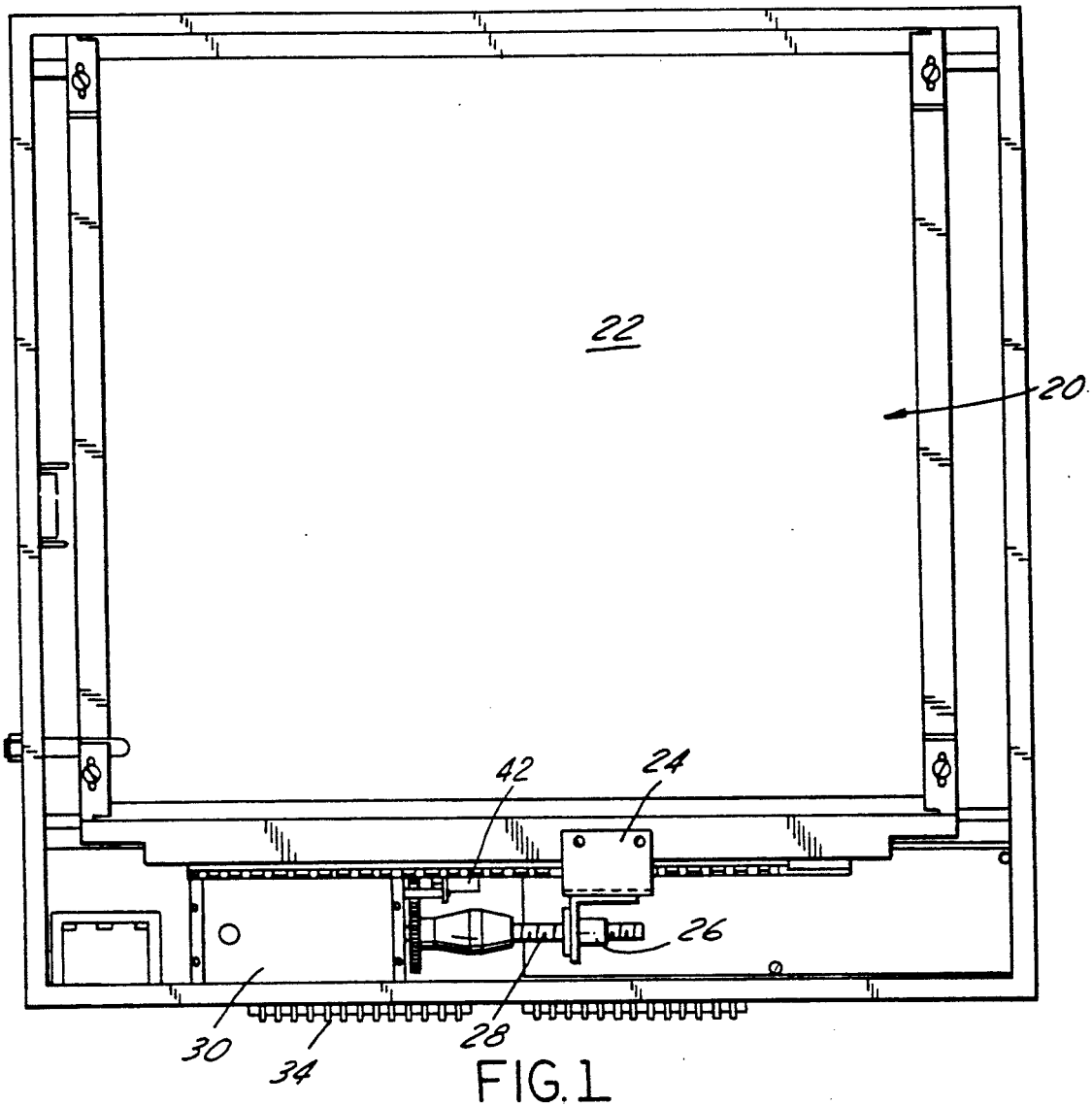
FIG. 1 is a top view of the inventive bucky system.

An improved bucky system 20 is illustrated in FIG. 1 including a bucky grid 22. A plate 24 is fixed for movement with grid 22, and also fixed to a nut 26. Nut 26 is internally threaded and received on an externally threaded screw 28. Screw 28 is driven by a DC motor 30. DC motor 30 is preferably reversible such that screw 28 can be rotated in a first direction to drive nut 26, and hence bucky grid 22 in a first linear direction to the end of travel of the bucky grid. At the end of travel the motor is reversed and the grid returns to its original location. IC board motor control 32 is positioned adjacent the motor, and a control interface 34 with the x-ray system is positioned at one side of the bucky system 20.

Figure 2:
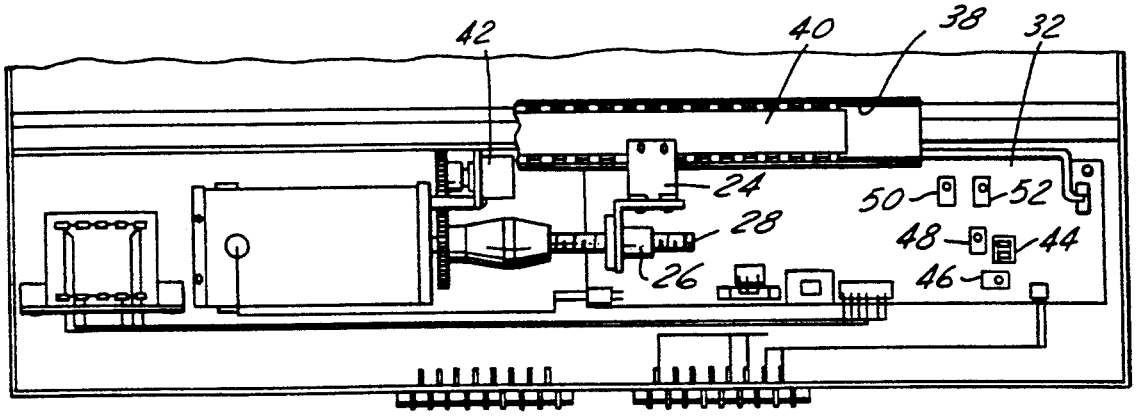
FIG. 2 is a partial view similar to FIG. 1, but showing several features in a cutaway section.

As shown in FIG. 2, the motor has been rotated such that nut 26, and hence bucky grid 22 has moved from the FIG. 1 position in a direction to the left as shown in this figure. As also shown on the cutaway, rails 38 mount guides 40 from the bucky grid 22.

In control features of this invention, the motor is a DC motor with an attached position sensing potentiometer 42. Speed control is implemented using a power transistor which may be configured as a full bridge chopper. Four transistors are preferably utilized to provide drive in forward and reverse directions.

The bucky system 20 may be operated in either an automatic mode or a semi-automatic mode. In the automatic mode, the bucky is activated by the x-ray generator. When the generator is energized and ready to expose film, it provides a contact closure to the bucky system. The bucky system then begins its cycle. Once the grid is up to speed, a bucky exposure relay closes an external connection (in interface 34) to the exposure relay of the x-ray generator. This will cause the x-ray generator to expose the x-ray film.

In a semi-automatic mode, power to the bucky is controlled by the operator through an external on/off switch 44. After the x-ray generator has been energized, the bucky must be independently activated by the operator using the switch. Again, once the grid is up to speed, a bucky exposure relay closes which causes the x-ray generator to expose the film. The interface controls 34 allow the bucky to be wired to function in either the automatic or semi-automatic mode.

The bucky may operate in at least two grid speeds. The bucky may include a switch utilized to select speeds, of for example 7.4 or 4.0 inches per second. The switch allows the operator to pick a desired bucky speed.

Further, the bucky circuit board allows selection of the line voltage on which the bucky will operate. Thus, the bucky operating voltage may be selected between 115 to 230 volts.

Potentiometers 46, 48, 50, 52 may be utilized to allow adjustment of the bucky high and low speed, the grid travel distance, and the x-ray enable delay distance. The x-ray enable delay distance is a distance selected to allow the bucky grid to come up to speed before the x-ray generator is actuated. The details of such controls are within the skill of a worker in the art.

The inventive bucky may accept an ion chamber for use in regulating x-ray exposure times. The ion chamber may be installed at the front or the side of the bucky.

Although a preferred embodiment of the present invention have been disclosed, a worker of ordinary skill in the art would recognize that certain modifications would come within the scope of this invention. For that reason the following claims should be studied in order to determine the true scope and content of this invention.

We claim:

1. A bucky for use with an x-ray system comprising:

a grid;

a mechanical drive to reciprocate said grid, said mechanical drive including a reversible rotary motor which is connected to said grid by a rotary to reciprocating connection such that said rotary motor causes said grid to reciprocate; and an integrated circuit chip control for said motor, wherein said bucky may be operated in a semi-automatic mode in which an operator must actuate said motor, and said bucky may alternatively be operated in an automatic mode in which a signal from an x-ray generator utilized with said bucky actuates said motor.

2. A bucky for use with an x-ray system comprising:

a grid;

a mechanical drive to reciprocate said grid, said mechanical drive including a reversible rotary motor which is connected to said grid by a rotary to reciprocating connection such that said rotary motor causes said grid to reciprocate; and an integrated circuit chip control for said motor, wherein said motor may be selectively operated in at least two speeds.

3. A bucky for use with an x-ray system comprising:

a grid;

a mechanical drive to reciprocate said grid, said mechanical drive including a reversible rotary motor which is connected to said grid by a rotary to reciprocating connection such that said rotary motor causes said grid to reciprocate; and an integrated circuit chip control for said motor, wherein potentiometers allow selective adjustment of the motor speed and the grid travel distance.

4. A bucky as recited in claim 3, wherein said grid begins movement after actuation by said motor through a delay distance, said control sending a signal to an x-ray generator to actuate an x-ray exposure after said grid has moved through said delay distance, and there being means to adjust said delay distance.

* * * * *